US008044917B2

(12) United States Patent
Oh et al.

(10) Patent No.: US 8,044,917 B2
(45) Date of Patent: Oct. 25, 2011

(54) LIQUID CRYSTAL DISPLAY DEVICE

(75) Inventors: Dong Kyoung Oh, Daegu-si (KR); Jin Ha Lee, Daegu-si (KR)

(73) Assignee: LG Display Co., Ltd., Seoul (KR)

( * ) Notice: Subject to any disclaimer, the term of this patent is extended or adjusted under 35 U.S.C. 154(b) by 1064 days.

(21) Appl. No.: 11/643,654

(22) Filed: Dec. 22, 2006

(65) Prior Publication Data

US 2008/0001894 A1 Jan. 3, 2008

(30) Foreign Application Priority Data

Jun. 29, 2006 (KR) ..... 10-2006-0059794

(51) Int. Cl.
*G09G 3/36* (2006.01)

(52) U.S. Cl. ..... 345/100; 345/99; 345/204; 345/519; 345/212; 345/213

(58) Field of Classification Search ..... 345/99, 345/100, 204, 105, 519, 208, 211–213
See application file for complete search history.

(56) References Cited

U.S. PATENT DOCUMENTS

| | | | | |
|---|---|---|---|---|
| 6,255,888 | B1 | 7/2001 | Satomi | |
| 6,670,939 | B2 * | 12/2003 | Yang et al. | 345/98 |
| 7,098,886 | B2 * | 8/2006 | La | 345/99 |
| 7,106,319 | B2 | 9/2006 | Ishiyama | |
| 7,184,011 | B2 * | 2/2007 | Lee et al. | 345/99 |
| 7,427,985 | B2 * | 9/2008 | Chen et al. | 345/204 |
| 7,724,233 | B2 * | 5/2010 | Lai | 345/102 |
| 2003/0122814 | A1 * | 7/2003 | Yer | 345/211 |
| 2003/0173995 | A1 | 9/2003 | Cairns et al. | |
| 2004/0012581 | A1 | 1/2004 | Kurokawa et al. | |
| 2004/0113907 | A1 * | 6/2004 | Lee et al. | 345/211 |
| 2005/0088391 | A1 | 4/2005 | Kim | |
| 2005/0140631 | A1 | 6/2005 | Oh et al. | |
| 2006/0132417 | A1 | 6/2006 | Shigenobu et al. | |
| 2008/0143662 | A1 * | 6/2008 | Hong | 345/92 |
| 2008/0158234 | A1 * | 7/2008 | Kim | 345/501 |

FOREIGN PATENT DOCUMENTS

| | | | |
|---|---|---|---|
| DE | 102004050392 | A1 | 7/2005 |
| JP | 11-95726 | A | 4/1999 |
| JP | 11-274912 | A2 | 10/1999 |
| JP | 11-306784 | A | 11/1999 |
| JP | 2002-366114 | A | 12/2002 |
| JP | 2003-330434 | A2 | 11/2003 |
| JP | 2004-29540 | A | 1/2004 |
| JP | 2005-196196 | A | 7/2005 |
| JP | 2005-215452 | A | 8/2005 |
| JP | 2006-18149 | A | 1/2006 |

* cited by examiner

*Primary Examiner* — Lun-Yi Lao
*Assistant Examiner* — Gregory J Tryder
(74) *Attorney, Agent, or Firm* — Birch, Stewart, Kolasch & Birch, LLP

(57) ABSTRACT

A liquid crystal display device including a liquid crystal panel, a gate driver configured to drive a plurality of gate lines on the panel, a data driver configured to drive a plurality of data lines on the panel in response to the pixel data stream, a timing controller configured to control the gate driver and the data driver, and a single-chip drive voltage generating section configured to supply voltages used by the common electrode on the liquid crystal panel, the gate driver, the data driver, and the timing controller using an external input voltage.

15 Claims, 4 Drawing Sheets

LIQUID CRYSTAL DISPLAY DEVICE

CROSS-REFERENCE TO RELATED APPLICATIONS

This application claims the benefit of Korean Patent Application No. 10-2006-0059794, filed on Jun. 29, 2006, in the Korean Intellectual Property Office, the disclosure of which is incorporated herein by reference.

BACKGROUND

1. Field of the Invention

The present invention relates to a flat panel display device, and more particularly to a liquid crystal display device with a reduced size and number of parts.

2. Description of Related Art

Various flat panel display devices such as an LCD (Liquid Crystal Display) device, a PDP (Plasma Display Panel), and an ELD (Electro Luminescent Display) are used as display devices in different types of equipment. The LCD device is most widely used as a portable image display device due to its excellent image quality, its light weight, its slimness, and its low power consumption. The LCD device is used as a television monitor, a monitor of a notebook computer, etc.

The LCD device displays an image using the optical anisotropy and the polarity of a liquid crystal. That is, the liquid crystal molecules included in the liquid crystal can be arranged in a predetermined (constant) direction. Further, the direction of the liquid crystal molecule arrangement can be controlled by applying an electric field to the liquid crystal. Therefore, when the molecule arrangement direction of the liquid crystal is arbitrary, the molecule arrangement of the liquid crystal can be changed by applying an electric field. In addition, image information can be displayed by changing the polarization of light in the molecule arrangement direction of the liquid crystal using the optical anisotropy.

Also, the LCD device includes a liquid crystal panel displaying an image and a drive section for driving the liquid crystal panel. The drive section includes a gate driver driving a plurality of gate lines on the liquid crystal panel and a data driver driving a plurality of data lines on the liquid crystal panel. Further, the drive section also includes a timing controller controlling the gate and data drivers and a voltage generating section generating drive voltages required for the liquid crystal panel, the gate driver, the data driver, and the timing controller.

In addition, the voltage generating section generates a gate low voltage VGL and a gate high voltage VGH for driving the gate lines and supplies the gate low and high voltages to the gate driver. The voltage generating section also supplies at least two drive voltages (e.g., Vdd and Vcc) used for driving the circuit devices to the gate driver, the data driver, and the timing controller. In addition, the voltage generating section supplies a common voltage Vcom used as a reference voltage to the liquid crystal panel. Also, the voltage generating section is mounted on a printed circuit board together with the timing controller.

In addition, the printed circuit board including the mounted timing controller is individually provided with a gate low voltage generating circuit for generating the gate low voltage VGL, a gate high voltage generating circuit for generating the gate high voltage VGH, a drive voltage generating circuit for generating the at least two drive voltages, and a common voltage generating circuit for generating the common voltage. Further, wires for transferring voltages from the voltage generating circuits to the liquid crystal panel, the gate driver, the data driver, and the timing controller are formed on the printed circuit board.

Thus, because the voltage generating circuits for generating voltages required for the liquid crystal panel, the gate driver, the data driver, and the timing controller are individually formed on the printed circuit board, a large number of devices are mounted on the printed circuit board. Accordingly, the size of the printed circuit board is larger. Therefore, the size and thickness of the related art LCD device is also increased and the manufacturing time and cost is increased.

SUMMARY OF THE INVENTION

Accordingly, the present invention is directed to an LCD device and corresponding driving method that substantially obviates one or more of the problems due to limitations and disadvantages of the related art.

Another object of the present invention is to provide an LCD device that has a reduced size and number of parts.

To achieve these and other advantages and in accordance with the purpose of the present invention, as embodied and broadly described herein, the present invention provides in one aspect a liquid crystal display device including a liquid crystal panel having a plurality of liquid crystal pixels formed in regions divided by a plurality of gate lines and a plurality of data lines, each of the pixels selected by a signal on a corresponding gate line and driven by a differential voltage between a voltage on a corresponding data line and a voltage on a common electrode. The liquid crystal display device also includes a gate driver configured to drive the plurality of gate lines, a data driver configured to drive the plurality of data lines in response to a pixel data stream, a timing controller configured to control the gate driver and the data driver, and a single-chip drive voltage generating section configured to supply voltages used by the common electrode on the liquid crystal panel, the gate driver, the data driver, and the timing controller using an external input voltage. The present invention also provides a corresponding method of driving and manufacturing the liquid crystal display device.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

DETAILED DESCRIPTION OF PREFERRED EMBODIMENTS

Hereinafter, preferred embodiments according to the present invention will be described with reference to the accompanying drawings.

Figure 1:
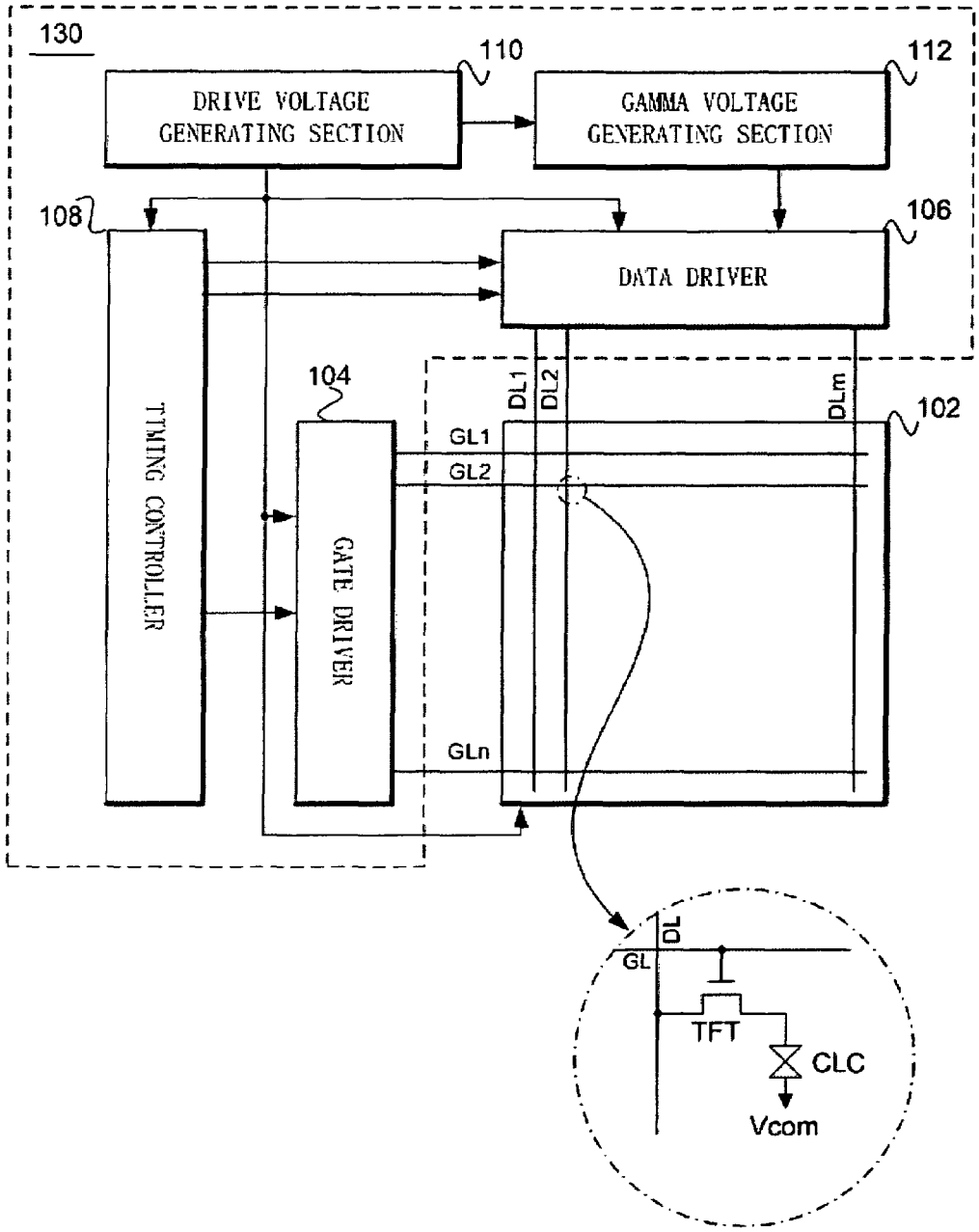
FIG. 1 is a block diagram illustrating an LCD device according to a preferred embodiment of the present invention.

Turning first to FIG. 1, which is a block diagram illustrating an LCD device according to a preferred embodiment of the present invention. As shown, the LCD device includes a drive section 130 for driving a liquid crystal panel 102. Further, the liquid crystal panel 102 displays an image corresponding to video data, for example.

In addition, the liquid crystal panel 102 includes a first substrate in which a plurality of thin film transistors TFT are formed, a second substrate in which color filters are formed, and a liquid crystal layer located between the substrates. Further, the first substrate includes a plurality of gate lines GL and a plurality of data lines DL which are arranged so as to cross each other. The first substrate is divided into a plurality of unit pixel regions by the gate lines GL and the data lines DL, and the thin film transistor and a pixel electrode are formed in each unit pixel region.

Further, a common electrode is formed in one of the first and second substrates. In the thin film transistor TFT, when the corresponding gate line GL is enabled by a high electrical potential voltage, a pixel data voltage on the corresponding data line is charged between the corresponding pixel electrode and the common electrode. Also, the liquid crystal layer regulates the amount of light passing through a unit pixel region according to the level of the voltage charged between the common electrode and the pixel electrode and thereby displays an image.

In addition, as shown in FIG. 1, the drive section 130 includes a gate driver 104 driving the plurality of gate lines GL, a data driver 106 driving the plurality of data lines DL, and a timing controller 108 controlling the gate driver 104 and the data driver 106. The drive section 130 also includes a gamma voltage generating section 112 supplying gamma voltages used by the data driver 106, and a drive voltage generating section 110 generating a plurality of voltages used by the common electrode of the liquid crystal panel 102, the gate driver 104, the data driver 106, the timing controller 108, and the gamma voltage generating section 112.

Further, the gate driver 104 selectively supplies a gate high voltage VGH and a gate low voltage VGL from the drive voltage generating section 110 to the plurality of gate lines GL in response to the gate control signal supplied from the timing controller 108. Thus, because of the gate driver 104, the gate lines GL on the liquid crystal panel 102 are sequentially enabled by a predetermined period (e.g., a period of a horizontal synchronous signal).

In addition, the data driver 106 supplies the pixel data voltages to the plurality of data lines DL on the liquid crystal panel 102 in response to the data control signal supplied from the timing controller 108. Also, the data driver 106 inputs RGB pixel data by one line from the timing controller 108. The data driver 106 converts the pixel data input by one line into analog pixel data voltages using the gamma voltages from the gamma voltage generating section 112. The one line of converted data voltages are then supplied to the plurality of data lines DL on the liquid crystal panel 102.

In addition, the timing controller 108 generates a gate control signal for controlling the gate driver 104 and a data control signal for controlling the data driver 106 in response to a vertical/horizontal synchronous signal Vsync/Hsync, a data enable signal DE, and a clock signal CLK which are supplied from an external system (not shown) (e.g., a graphic module of a computer system or an image demodulating module of a TV set). Further, the timing controller 108 transfers the RGB pixel data in an image unit, which is supplied from an external system, to the data driver 106 by one line.

The gamma voltage generating section 112 uses first and second supply voltages Vdd and Vss generated in the drive voltage generating section 110 and generates a plurality of gamma voltages of different levels. In addition, the gamma voltage generating section 112 includes a resistor-voltage divider (not shown) connected in series between the first and second supply voltages Vdd and Vss. The voltages divided by the resistor-voltage divider are supplied to the data driver 106 as gamma voltages.

The drive voltage generating section 110 generates the gate high voltage VGH and the gate low voltage VGL used for driving the gate lines GL. Further, the drive voltage generating section 110 generates the common voltage Vcom to be supplied to the common electrode of the liquid crystal panel 102. In addition, the drive voltage generating section 110 generates first to third supply voltages Vdd, Vss, and Vcc used for driving the gate driver 104, the data driver 106, the timing controller 108, and the gamma voltage generating section 112.

The circuits generating the gate high and low voltages VGH and VGL, the common voltage Vcom, and the first to third supply voltages Vdd, Vss, and Vcc are formed in the drive voltage generating section 110 as a single chip. In other words, the drive voltage generating section 110 is manufactured as a single chip. The single-chip drive voltage generating section 110 is mounted to a printed circuit board (not shown) together with the timing controller 108 and the gamma voltage generating section 112.

In addition, the single-chip drive voltage generating section 110 occupies a small area on the printed circuit board and can be mounted adjacently to the timing controller 108 and the gamma voltage generating section 112. In addition, the single-chip drive voltage generating section 110 shortens the length of a wire used in the printed circuit board. Accordingly, the number of circuit devices on the printed circuit board and the size of the printed circuit board can be reduced. Consequently, the size and/or thickness of the LCD device can be reduced.

Figure 2:
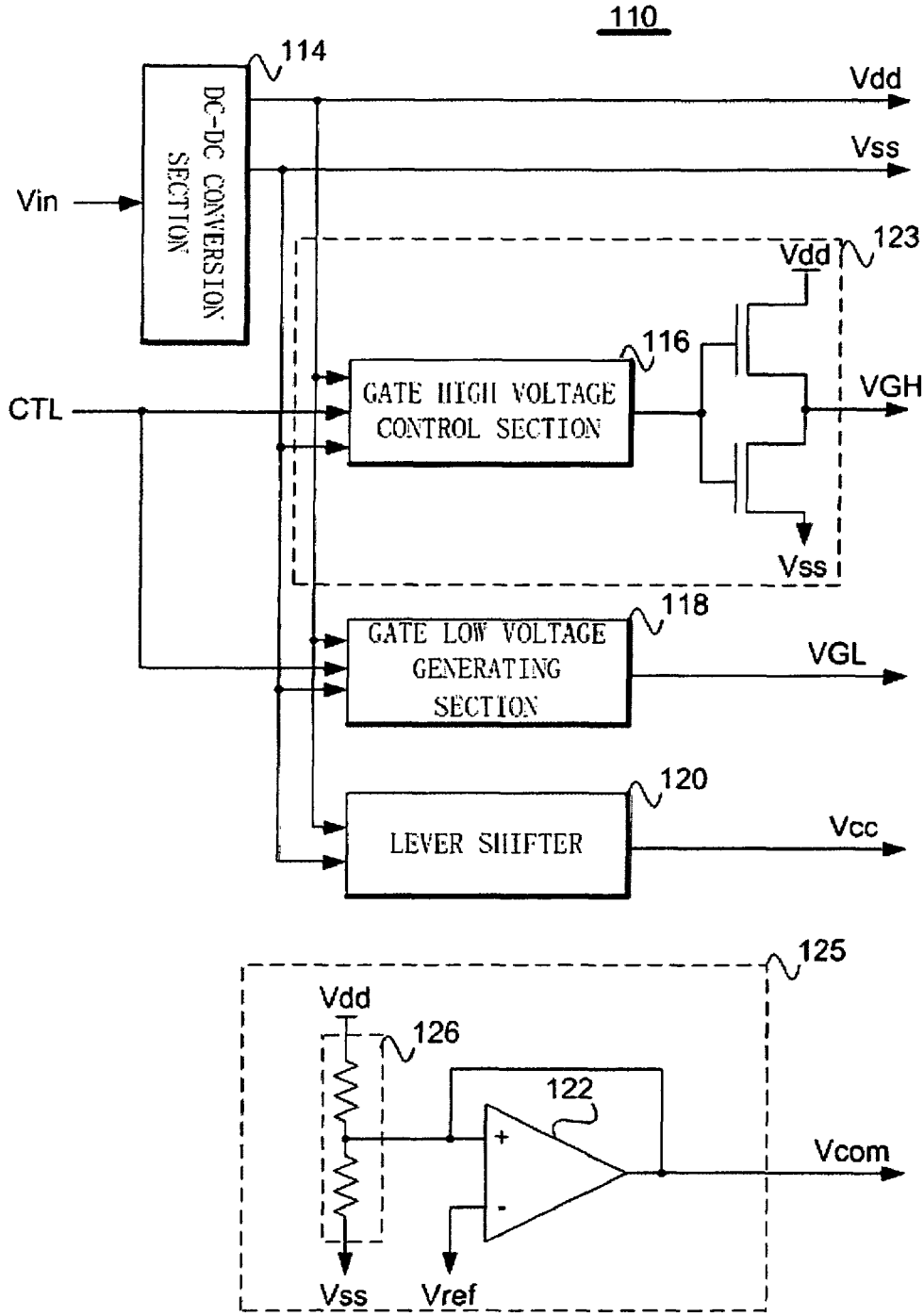
FIG. 2 is a circuit diagram illustrating in detail a drive voltage generating section shown in FIG. 1.

Next, FIG. 2 is a circuit diagram illustrating in detail the drive voltage generating section 110 shown in FIG. 1. As shown in FIG. 2, the drive voltage generating section 110 includes a DC-DC conversion section 114 inputting an input voltage Vin from an external system (e.g., a power supply unit of a computer system or a power supply unit of a TV set), a gate low voltage generating section 118, a level shifter 120, a gate high voltage generating section 123, and a common voltage generating section 125 commonly inputting a first supply voltage Vdd from the DC-DC conversion section 114.

The DC-DC conversion section 114 generates a first supply voltage Vdd of a high potential and a second supply voltage Vss of a low potential using an input voltage Vin from a power source unit of the external system. More particularly, the DC-DC conversion section 114 generates a first supply voltage Vdd of a high potential and a second supply voltage Vss of a low potential stably maintaining the required levels by converting the input voltage to an AC voltage and then reconverting the AC voltage to a DC voltage.

The first supply voltage Vdd of a high potential is used to drive a circuit device of a relatively high capacity such as a MOS transistor, while the second supply voltage Vss of a low potential is used as a base voltage (e.g., GND). In addition, the first supply voltage Vdd generated in the DC-DC conversion section 114 is supplied to the data driver 106 and the gamma voltage generating section 112 as shown in FIG. 1. Also, the second supply voltage Vss is supplied to the gate driver 104, the data driver 106, the timing controller 108, and the gamma voltage generating section 112.

Further, the level shifter 120 generates a third supply voltage Vcc by down-shifting the level of the first supply voltage Vdd from the DC-DC conversion section 114. The third supply voltage Vcc constantly maintains a high potential level lower than the first supply voltage Vdd and higher than the second supply voltage Vss. In addition, the third supply voltage Vcc is used to drive the logic devices requiring a relatively low voltage. Accordingly, the third supply voltage Vcc generated in the level shift 120 is supplied to the gate drive 104, the data driver 106, and the timing controller 108 shown in FIG. 1.

Also, the gate high voltage generating section 123 includes a gate high voltage control section 116 responding to a control signal CTL and first and second transistors T1 and T2 commonly connected to an output terminal of the gate high voltage control section 116. The first and second supply voltages from the DC-DC conversion section 114 are also supplied to the gate high voltage control section 116. As shown, a source terminal of the first transistor T1 is connected to an output line of the first supply voltage Vdd of the DC-DC converter 114 and a drain terminal of the first transistor T1 is connected to the gate driver 104 shown in FIG. 1 together with the source terminal of the second transistor T2.

In addition, the drain terminal of the second transistor T2 is connected to the output terminal of the second supply voltage Vss of the DC-DC converter 114. The gate high voltage control section 116 is enabled by the control signal CTL from the external system or the timing controller 108 to drive the first and second transistors T1 and T2. Further, the first and second transistors T1 and T2 allow the voltage on the input terminal of the gate driver 104 to be positive-pumped by switching the first and second supply voltages Vdd and Vss.

The positive-pumped voltage is then supplied to the gate driver 104 of FIG. 1 as a gate high voltage VGH. The gate high voltage VGH is selectively supplied to a plurality of gate lines GL via the gate driver 104 to selectively enable the plurality of gate lines GL. Further, the thin film transistor TFT on the selectively enabled gate line is turned on.

Like the gate high voltage generating section 123, the gate low voltage generating section 118 is enabled by the control signal CTL from the external system or the timing controller of FIG. 1. When enabled, the gate low voltage generating section 118 allows the voltage on the input terminal of the gate driver 104 to be negative-pumped by switching the first and second supply voltages Vdd and Vss from the DC-DC conversion section 114. Accordingly, a gate low voltage VGL to be supplied to the gate driver 104 of FIG. 1 is generated in the gate low voltage generating section 118. The gate low voltage VGL is selectively supplied to the plurality of gate lines GL via the gate driver 104 to selectively disable the plurality of gate lines GL. In addition, the thin film transistor TFT on the disabled gate line GL is turned off.

As shown in FIG. 2, the common voltage generating section 125 includes a voltage dividing section 126 inputting first and second supply voltages Vdd and Vss from the DC-DC conversion section 114 and a buffer section 122 connected to the voltage dividing section 126. The voltage dividing section 126 includes two resistors connected in series between the output lines of the first and second supply voltages VDD and Vss of the DC-DC conversion section 114.

The two resistors divide the difference voltage between the first and second supply voltages Vdd and Vss and supply the divided voltages to the buffer section. The divided voltage from the voltage dividing section 126 is input to a non-inverting input terminal (+) and a reference voltage Vref is input to an inverting input terminal (−) of the buffer section 122. Further, the buffer section 122 buffers the divided voltage from the voltage dividing section 126 and supplies the buffered voltage to the common electrode on the liquid crystal panel 102 of FIG. 1 as a common voltage Vcom.

In addition, the DC-DC conversion section 114, the level shift 120, the gate low voltage generating section 118, the level shift 120, and the gate high voltage generating section 123 are provided in one chip. In other words, the drive voltage generating section 110 is manufactured in the form of one chip and generates the gate high and low voltages VGH and VGL, the common voltage Vcom, and the first to third supply voltages Vdd, Vss, and Vcc.

As discussed above, the single-chip drive voltage generating section 110 occupies a small area on the printed circuit board and can be mounted adjacently to the timing controller 108 and the gamma voltage generating section 112. In addition, the single-chip drive voltage generating section 110 shortens the length of the wire in the printed circuit board. Accordingly, the number of circuit devices on the printed circuit board and the size of the printed circuit board can be reduced. Consequently, the size and/or thickness of the LCD device can be reduced.

Figure 3:
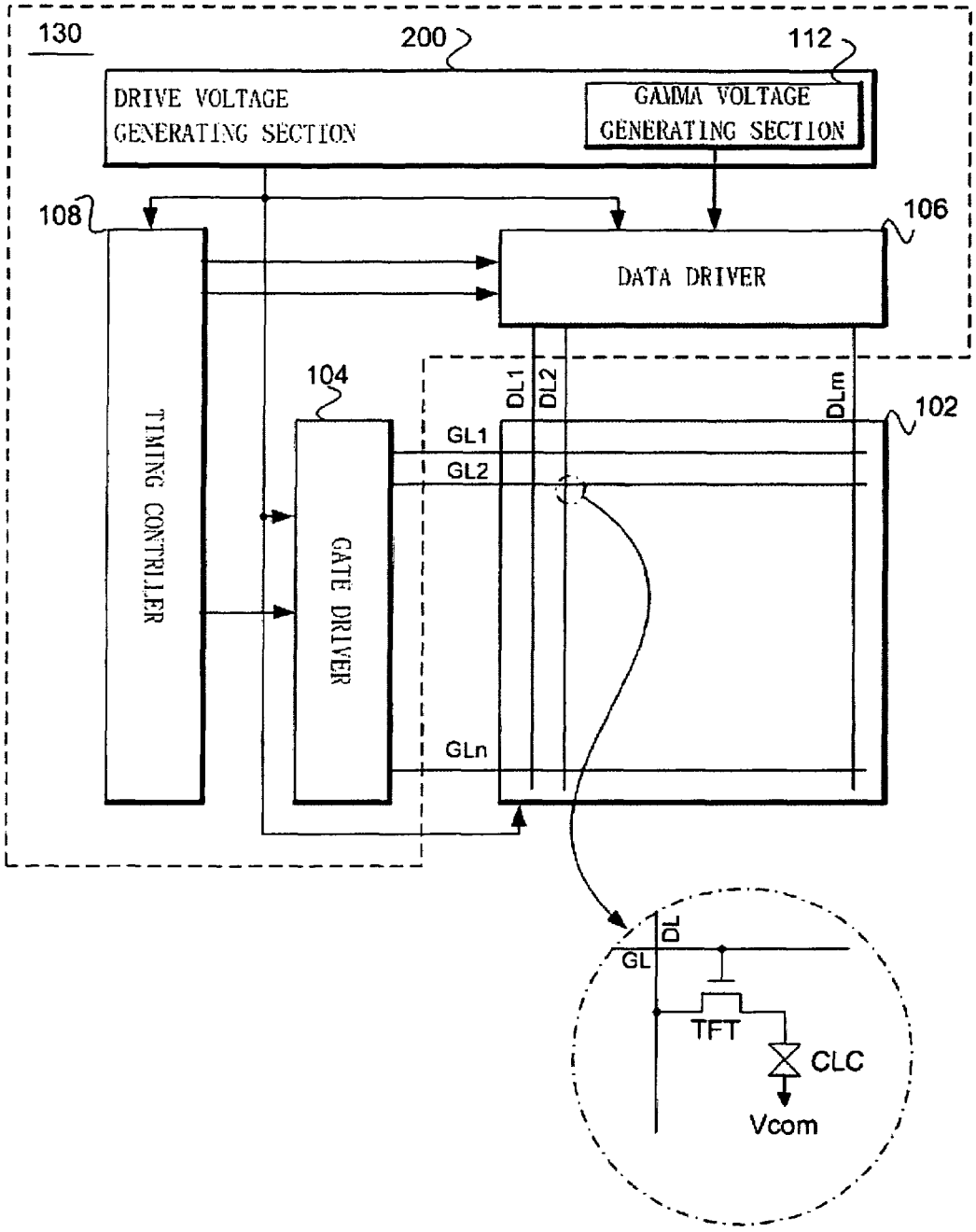
FIG. 3 is a block diagram illustrating an LCD device according to another preferred embodiment of the present invention.

Next, FIG. 3 is a block diagram for explaining an LCD device according to another preferred embodiment of the present invention. The LCD device of FIG. 3 has the same construction as that of the LCD device shown in FIG. 1, except that a drive voltage generating section 200 includes the gamma voltage generating section 112 and the data driver 106 receives gamma voltages from the gamma voltage generating section 112 in the drive voltage generating section 200. Thus, the elements of FIG. 3 which have the same name, function, and effect as those of the elements shown in FIG. 1 will be referred to by the same reference numerals, and the detailed description of the elements will be omitted.

Like the drive voltage generating section 110 shown in FIG. 1, the drive voltage generating section 200 embedding the gamma voltage generating section 112 generates gate high and low voltages VGH and VGL, first to third supply voltages Vdd, Vss, and Vcc, and a common voltage Vcom. In addition, the drive voltage generating section 200 supplies gamma voltages generated in the gamma voltage generating section 112 embedded therein to the data driver 106.

As mentioned above, the drive voltage generating section 200 includes a circuit generating gamma voltages in addition to the circuits generating gate high and low voltages VGH and VGL, a common voltage Vcom, and first to third supply voltages Vdd, Vss, and Vcc. Further, the drive voltage generating section 200 is manufactured in the form of one chip. The single-chip drive voltage generating section 200 is also mounted to a printed circuit board together with the timing controller 108.

The single-chip drive voltage generating section 200 occupies a small area on the printed circuit board and can be mounted adjacently to the timing controller 108. In addition, the single-chip drive voltage generating section 200 shortens the length of a wire in the printed circuit board. Accordingly, the number of circuit devices and the size of the printed circuit board can be reduced. Consequently, the size and/or thickness of the LCD device can be reduced.

Figure 4:
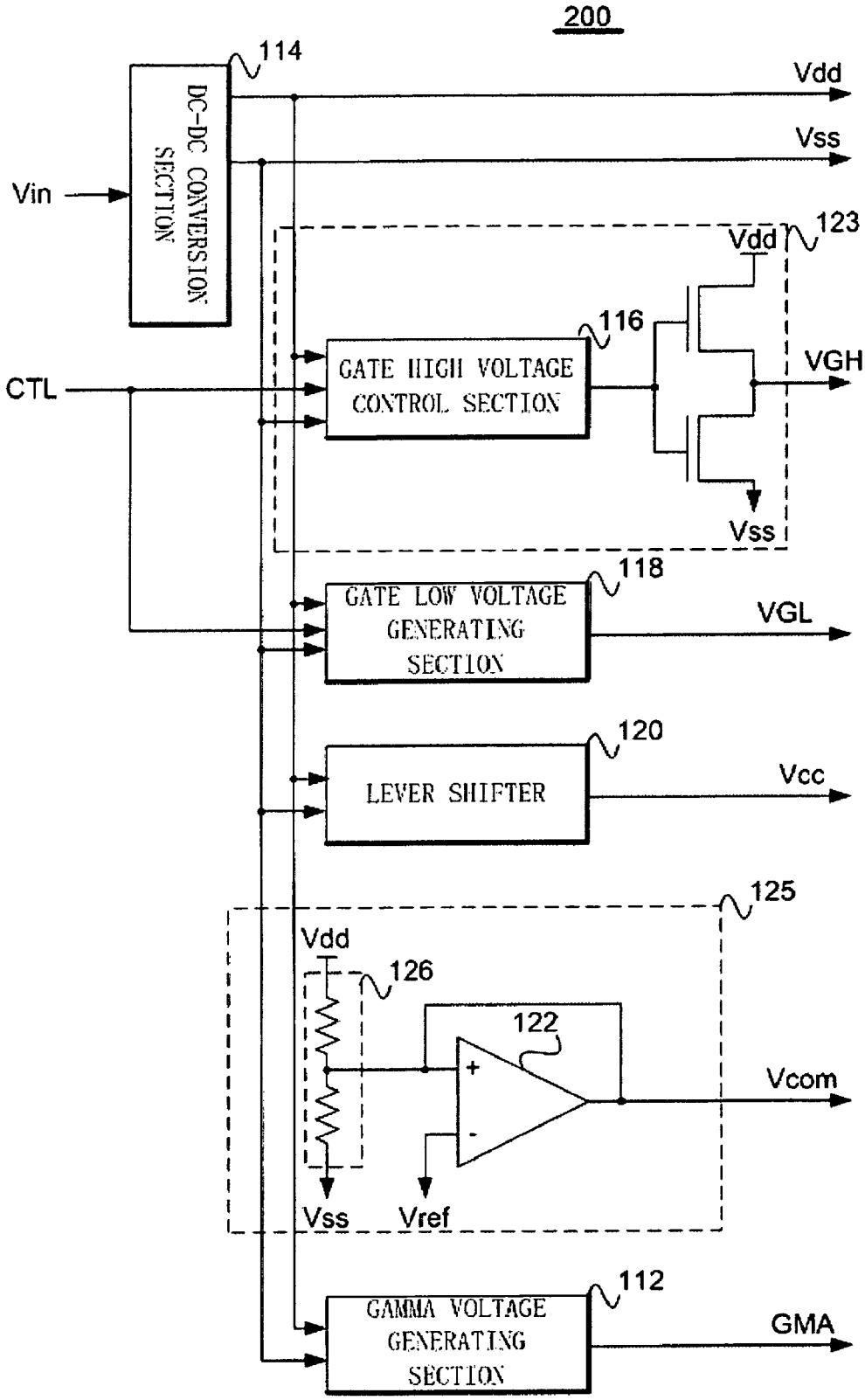
FIG. 4 is a circuit diagram illustrating a drive voltage generating section shown in FIG. 3.

Turning next to FIG. 4, which is a circuit diagram illustrating in detail the drive voltage generating section 200 shown in FIG. 3. The drive voltage generating section 200 of FIG. 4 has the same construction as that of the drive voltage generating section 110 of FIG. 2, except that the drive voltage generating section 112 further includes the gamma voltage generating section 112. Thus, the elements of FIG. 4 which have the same name, function, and effect as those of the elements shown in FIG. 2 will be referred to by the same reference numerals, and the detailed description of the elements will be omitted.

The gamma voltage generating section 112 included in the drive voltage generating section 200 of FIG. 4 inputs the first and second supply voltages Vdd and Vss from the DC-DC conversion section 114. The gamma voltage generating section 112 generates a plurality of gamma voltages of different levels using the first and second supply voltages Vdd and Vss.

In addition, the gamma voltage generating section 112 includes a resistance voltage divider (not shown) connected in series between output lines of the first and second supply voltages Vdd and Vss of the DC-DC conversion section 114. The voltages divided by the resistance voltage divider are supplied to the data driver 106 as gamma voltages GMA.

As mentioned above, the drive voltage generating section 200 includes a circuit generating gamma voltages in addition to the circuits generating the gate high and low voltages VGH and VGL, a common voltage Vcom, and first to third supply voltages Vdd, Vss, and Vcc. Further, the drive voltage generating section 200 is manufactured in the form of one chip. The single-chip drive voltage generating section 200 is mounted to a printed circuit board together with the timing controller 108.

Further, the single-chip drive voltage generating section 200 occupies a small area on the printed circuit board and can be mounted adjacently to the timing controller 108. In addition, the single-chip drive voltage generating section 200 shortens the length of a wire in the printed circuit board. Accordingly, the number of circuit devices and the size of the printed circuit board can be reduced. Consequently, the size and/or thickness of the LCD device can be reduced.

As mentioned above, in the LCD device according to the present invention, the drive voltages required for the liquid crystal panel and the drive circuit thereof can be generated in the single-chip drive voltage generating IC chip. The single-chip drive voltage generating section occupies a small area on the printed circuit board and can be mounted adjacently to the timing controller. In addition, the single-chip drive voltage generating section shortens the length of a wire in the printed circuit board. Accordingly, the number of circuit devices and the size of the printed circuit board can be reduced further. Consequently, the size and/or thickness of the LCD device can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A liquid crystal display device, comprising:

a liquid crystal panel including a plurality of liquid crystal pixels formed in regions divided by a plurality of gate lines and a plurality of data lines, each of the pixels selected by a signal on a corresponding gate line and driven by a differential voltage between a voltage on a corresponding data line and a voltage on a common electrode;

a gate driver configured to drive the plurality of gate lines;

a data driver configured to drive the plurality of data lines in response to a pixel data stream;

a timing controller configured to control the gate driver and the data driver; and a single-chip drive voltage generating section configured to supply voltages used by the common electrode on the liquid crystal panel, the gate driver, the data driver, and the timing controller using an external input voltage, wherein the drive voltage generating section comprises a DC-DC converter configured to generate a first supply voltage constantly maintaining a high potential by DC-DC converting the input voltage and a second supply voltage of a base potential, a gate high voltage generating section configured to generate a gate high voltage, allowing the gate driver to selectively drive the gate lines, using the first and second supply voltages, a gate low voltage generating section configured to generate a gate low voltage, allowing the gate driver to selectively disable the gate lines, using the first and second supply voltages, a level shifter configured to generate a third supply voltage, used for driving the gate driver, the data driver, and the timing controller, by level-shifting the first supply voltage and a common voltage generating section configured to generate the common voltage to be supplied to the common electrode of the liquid panel, using the first and second supply voltages, wherein the gate high voltage generating section includes a gate high voltage control section responding to a control signal and first and second transistors commonly connected to an output terminal of the gate high voltage control section, and wherein the gate high voltage control section comprises a positive charge pump, and a positive-pumped voltage from the positive charge pump is supplied to the gate driver as the gate high voltage.

2. The liquid crystal display device according to claim 1, wherein the drive voltage generating section further comprises a gamma voltage generating section configured to generate gamma voltages to be supplied to the data driver by dividing the difference voltage between the first and second supply voltages into at least two parts.

3. The liquid crystal display device according to claim 1, wherein the gate high voltage generating section generates the gate high voltage by performing a positive voltage pumping operation in response to the control signal from the timing controller.

4. The liquid crystal display device according to claim 1, wherein the gate low voltage generating section generates the gate low voltage by performing a negative voltage pumping operation in response to the control signal from the timing controller.

5. The liquid crystal display device according to claim 1, wherein the common voltage generating section comprises:

a voltage divider configured to divide a difference voltage between the first and second supply voltages using two resistors connected in series between output lines of the first and second supply voltages; and a buffer configured to buffer the divided voltage from the voltage divider and provide the buffered voltage as a common voltage.

6. A method of driving a liquid crystal display device, the method comprising:

driving, via a gate driver, a plurality of gate lines on a liquid crystal display panel included in the liquid crystal display device;

driving, via a data driver, a plurality of data lines on the display panel in response to a pixel data stream;

controlling, via a timing controller, the gate driver and the data driver; and supplying, via a single-chip drive voltage generating section, supply voltages used by a common electrode on the liquid crystal panel, the gate driver, the data driver, and the timing controller using an external input voltage, wherein the supplying step comprises generating, via a DC-DC converter, a first supply voltage constantly maintaining a high potential by DC-DC converting the input voltage and a second supply voltage of a base potential, generating, via a gate high voltage generating section, a gate high voltage, allowing the gate driver to selectively drive the gate lines, using the first and second supply voltages, generating, via a gate low voltage generating section, a gate low voltage, allowing the gate driver to selectively disable the gate lines, using the first and second supply voltages, generating, via a level shifter, a third supply voltage used for driving the gate driver, the data driver, and the timing controller, by level-shifting the first supply voltage and generating, via a common voltage generating section, a common voltage to be supplied to the common electrode of the liquid panel, using the first and second supply voltages, wherein the gate high voltage generating section includes a gate high voltage control section responding to a control signal and first and second transistors commonly connected to an output terminal of the gate high voltage control section, and wherein the gate high voltage control section comprises a positive charge pump, and a positive-pumped voltage from the positive charge pump is supplied to the gate driver as the gate high voltage.

7. The method according to claim 6, wherein the supplying step further comprises generating, via a gamma voltage generating section, gamma voltages to be supplied to the data driver by dividing the difference voltage between the first and second supply voltages into at least two parts.

8. The method according to claim 6, wherein the gate high voltage generating section generates the gate high voltage by performing a positive voltage pumping operation in response to the control signal from the timing controller.

9. The method according to claim 6, wherein the gate low voltage generating section generates the gate low voltage by performing a negative voltage pumping operation in response to the control signal from the timing controller.

10. The method according to claim 6, wherein generating via the common voltage generating section comprises:

dividing, via a voltage divider, a difference voltage between the first and second supply voltages by two resistors connected in series between output lines of the first and second supply voltages; and buffering, via a buffer, the divided voltage from the voltage divider and provide the buffered voltage as a common voltage.

11. A method of manufacturing a liquid crystal display device, the method comprising:

forming a liquid crystal panel including a plurality of liquid crystal pixels in regions divided by a plurality of gate lines and a plurality of data lines, each of the pixels selected by a signal on a corresponding gate line and driven by a differential voltage between a voltage on a corresponding data line and a voltage on a common electrode;

mounting a gate driver configured to drive the plurality of gate lines on a printed circuit board;

mounting a data driver configured to drive the plurality of data lines in response to a pixel data stream on the printed circuit board;

mounting a timing controller configured to control the gate driver and the data driver on the printed circuit board;

mounting a single-chip drive voltage generating section configured to supply voltages used by the common electrode on the liquid crystal panel, the gate driver, the data driver, and the timing controller using an external input voltage on the printed circuit board; and connecting the printed circuit board to the liquid crystal panel via the data and gate lines, wherein the drive voltage generating section comprises a DC-DC converter configured to generate a first supply voltage constantly maintaining a high potential by DC-DC converting the input voltage and a second supply voltage of a base potential, a gate high voltage generating section configured to generate a gate high voltage, allowing the gate driver to selectively drive the gate lines, using the first and second supply voltages, a gate low voltage generating section configured to generate a gate low voltage, allowing the gate driver to selectively disable the gate lines, using the first and second supply voltages, a level shifter configured to generate a third supply voltage, used for driving the gate driver, the data driver, and the timing controller, by level-shifting the first supply voltage and a common voltage generating section configured to generate the common voltage to be supplied to the common electrode of the liquid panel, using the first and second supply voltages, wherein the gate high voltage generating section includes a gate high voltage control section responding to a control signal and first and second transistors commonly connected to an output terminal of the gate high voltage control section, and wherein the gate high voltage control section comprises a positive charge pump, and a positive-pumps voltage from the positive charge pump is supplied to the gate driver as the gate high voltage.

12. The method according to claim 11, wherein the drive voltage generating section further comprises a gamma voltage generating section configured to generate gamma voltages to be supplied to the data driver by dividing the difference voltage between the first and second supply voltages into at least two parts.

13. The method according to claim 11, wherein the gate high voltage generating section generates the gate high voltage by performing a positive voltage pumping operation in response to the control signal from the timing controller.

14. The method according to claim 11, wherein the gate low voltage generating section generates the gate low voltage by performing a negative voltage pumping operation in response to the control signal from the timing controller.

15. The method according to claim 11, wherein the common voltage generating section comprises:

a voltage divider configured to divide a difference voltage between the first and second supply voltages using two resistors connected in series between output lines of the first and second supply voltages; and a buffer configured to buffer the divided voltage from the voltage divider and provide the buffered voltage as a common voltage.

* * * * *